US005609391A

United States Patent [19]

Watts et al.

[11] Patent Number: 5,609,391

[45] **Date of Patent: *Mar. 11, 1997**

[54] CONVERTIBLE BENCH/TABLE CONTAINER APPARATUS

[75] Inventors: Stephen P. Watts, Orem; M. Brent Norton, Provo, both of Utah

[73] Assignee: Premiere Products, Provo, Utah

[ * ] Notice: The term of this patent shall not extend beyond the expiration date of Pat. No. 5,292,172.

[21] Appl. No.: 386,958

[22] Filed: Feb. 10, 1995

Related U.S. Application Data

[63] Continuation-in-part of Ser. No. 207,940, Mar. 8, 1994, Pat. No. 5,398,990, which is a continuation of Ser. No. 937,473, Aug. 28, 1992, Pat. No. 5,292,172.

[51] Int. Cl.[6] ..... A47B 85/06

[52] U.S. Cl. ..... 297/127; 297/125

[58] Field of Search ..... 297/127, 125, 297/126, 124, 157.1

[56] References Cited

U.S. PATENT DOCUMENTS

| | | | |
|---|---|---|---|
| 970,395 | 9/1910 | Rogers | 297/127 |
| 1,345,513 | 7/1920 | South | 297/127 |
| 1,532,417 | 4/1925 | Letts | 297/121 |
| 1,757,960 | 5/1930 | Greenstreet | 297/124 |
| 1,890,129 | 12/1932 | Ross . | |
| 2,481,935 | 9/1949 | Larson . | |
| 2,506,852 | 5/1950 | Barcus . | |
| 2,856,985 | 10/1958 | Lepper . | |
| 2,882,957 | 4/1959 | Anderson . | |
| 2,922,463 | 1/1960 | Johnston . | |
| 2,959,209 | 11/1960 | Lakin . | |
| 4,615,559 | 10/1986 | Blondeau | 297/124 |
| 5,292,172 | 3/1994 | Watts et al. | 297/127 |
| 5,398,990 | 3/1995 | Watts et al. | 297/127 |

OTHER PUBLICATIONS

"Easy Projects to Build & Finish," *Weekend Woodcrafts*, pp. 8–11, Issue 10, Aug. 1993.

*Primary Examiner*—Alexander Grosz
*Attorney, Agent, or Firm*—Broadbent, Hulse, Pierce & Pate

[57] ABSTRACT

A convertible bench/table container apparatus is disclosed in one presently preferred embodiment of the present invention as including a support container assembly having an internal storage chamber disposed therein for storing children's toys, clothing, blankets, for use as an ice chest, etc. The support container assembly is formed having a base board member and one or more openable seat members which provide means for facilitating access to the internal storage chamber of the support container assembly. Preferably, the seat members are hingeably attached at a first end to the base board member and operably disposed in alignment with the raised rim of the upper portion of the support container assembly to provide structural support when in the seat members are in a closed position. Connected to the base board member is an armrest assembly which provides structural support to a backrest/tabletop when the convertible bench/table container apparatus is pivoted from a bench position into a tabletop (or desktop) position. A hinge member accommodates for the pivotal movement of the convertible bench/table container apparatus into either a first or second position, and is rigidly attached to the armrest assembly and the base board member thereby providing a point of rotation thereon.

20 Claims, 4 Drawing Sheets

CONVERTIBLE BENCH/TABLE CONTAINER APPARATUS

RELATED APPLICATIONS

This application is a continuation-in-part of our application Ser. No. 08/207,940, filed on Mar. 8, 1994, now U. S. Pat. No. 5,398,990, for CONVERTIBLE BENCH/TABLE APPARATUS which is a continuation of our application Ser. No. 07/937,473, filed on Aug. 28, 1992 for CONVERTIBLE BENCH/TABLE APPARATUS, now issued as U. S. Pat. No. 5,292,172.

BACKGROUND

1. The Field of the Invention

This invention relates to recreational furniture, and more particularly, to a novel convertible bench/table container apparatus that conveniently transforms a backrest structure into a tabletop by novel means of incorporating a hinged armrest assembly that facilitates a conformation change when the backrest is lifted and pivoted on its side whereby exposing the tabletop.

2. The Background Art

Persons owning homes are common consumers of recreational patio and pool furniture. In most instances, homeowners purchase patio and pool furniture for the convenience and comfort they provide when leisurely relaxing outside or near a pool. Consumers of recreational furniture usually have an interest in the aesthetic beauty of a piece of patio or pool furniture and intend such furnishings to enhance the settings of their homes and to add decoration to their pool areas.

Benches have traditionally provided persons with a place to sit and relax outside in the yard, on the porch or near the pool. Many homeowners purchase lawn benches made of natural woods and finish them with a weather protecting varnish to ensure the longevity of the wood against the elements of nature. Although lawn benches have traditionally provided a means of sitting and relaxing in an outdoor setting, when it comes time to eating, no outdoor tabletop is available for supporting the dinnerware or the food to be eaten.

Many homeowners will accordingly purchase picnic tables as an appropriate means for placing foods thereon and in order to provide appropriate seating therearound for those persons eating. If a mere surface is needed for placing the food to be eaten on, and a seat for seating for those persons eating, then a picnic table suffices. However when the meal is completed, the bench associated with the picnic table no longer provides a comfortable advantage to those individuals seeking to relax and enjoy the outdoor setting. Typically, the only option of comfort while sitting on a picnic bench is to lean forward and rest your elbows on the tabletop. Although a picnic table provides a great function while eating outdoors, when it comes time to relax and enjoy the pleasant outdoor weather while communicating with family or friends, a park bench would provide a more comfortable piece of lawn furniture.

In view of the foregoing, a number of attempts have been made in the past to manufacture a convertible bench/table structure which provides a bench with a seat and backrest in one position, which can be further transformed into a seat with a tabletop structure, analogous to a picnic table, in a second position. Although the prior art combination park bench and picnic table afford significant advantages over the use of separate tables, benches and chairs, significant disadvantages remain.

For example, consumers generally desire a combination bench and table with a simple and easy means of converting the seat and backrest of the bench into the picnic table formation. Unfortunately, however, the prior art typically employs complicated mechanical latches and multiple pivotal points to accomplish a conformational transformation of the bench into a picnic table for dining. Likewise, the components of the prior art rely upon multiple working parts, a great number of nut and bolt assemblies, and an array of pivotal joints to construct the final working unit. Because of the necessity of numerous mechanical parts in the prior art, production and manufacturing costs are proportionately increased and ultimately passed on to the consumer.

In addition, the multiplicity of working parts, the arrangement of the various nut and bolt assemblies, and the array of pivotal joints in the final construction of prior art bench/table structures, present the consumer with a generally frustrating assembly process. In most situations, the consumer ends up trying to read and interpret lengthy and somewhat complicated instructions to assemble a working design of a prior art convertible bench/table structure for use.

Another disadvantage to prior art combination bench/table structures is the difficulty and sometimes awkward means of converting the bench and backrest into the picnic table conformation. In some instances, not only do pivotal pins have to be adjusted or frame members slidably modified in their adjacent slots, but with many known prior art convertible table/bench devices, the repositioning of the backrest into the tabletop position requires more than one individual to accomplish.

Considering all these factors, the prior art demands that consumers sacrifice a lengthy investment of time in assembling their final working units. And with the great numbers of mechanical working parts to assemble, the process of home construction is generally intensified thus forcing consumers to meticulously wade through in-depth and sometimes over technical instructions to realize any use from their so-called "recreational" furniture.

BRIEF SUMMARY AND OBJECTS OF THE INVENTION

In view of the foregoing, it is a primary object of the present invention to provide a new and improved functional and structural design for convertible bench/tables.

Another object of the present invention is to provide an aesthetically pleasing piece of recreational furniture made of natural redwood construction for finishing with an outdoor ultraviolet weather resistant stain to preserve the wood's beauty.

An additional object of the present invention is to provide a reduction in the number of mechanical working parts that will effect a decrease in the overall manufacturing and production costs of a convertible bench/table.

Further, it is an object of the present invention to provide a convertible bench/table which is easy to assemble.

It is a still further object of the present invention to provide a simpler and less awkward means for converting the backrest of the bench into a tabletop formation.

In addition, it is a still further object of the present invention to provide a convertible bench/table container apparatus having a support member comprising means for providing storage capacity.

Consistent with the foregoing objects, and in accordance with the invention as embodied and broadly described herein, a convertible bench/table container apparatus is disclosed in one presently preferred embodiment of the present invention as including a support container assembly having an internal storage chamber disposed therein for storing children's toys, clothing, blankets, for use as an ice chest, etc. The support container assembly is formed having a base board member and one or more openable seat members which provide means for facilitating access to the internal storage chamber of the support container assembly. Preferably, the seat members are hingeably attached at a first end to the base board member and operably disposed in alignment with the raised rim of the upper portion of the support container assembly to provide structural support when in the seat members are in a closed position.

Connected to the base board member is a novel armrest assembly that provides structural support to the convertible bench/table container apparatus when a backrest/tabletop is pivoted from a bench position into a tabletop (or desktop) position. A hinge member accommodates for the pivotal movement of the convertible bench/table container apparatus into either a first or second position, and is rigidly attached to the armrest assembly and the base board member whereby providing a point of rotation thereon.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 8, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
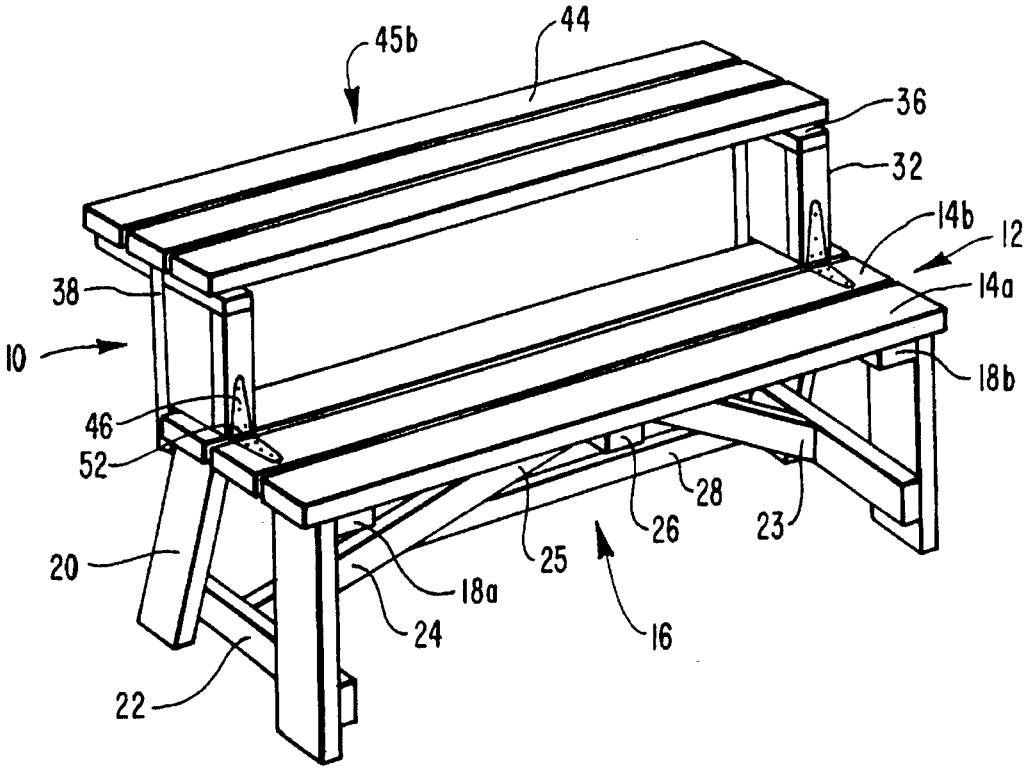
FIG. 1 is a perspective view illustrating one presently preferred embodiment of the convertible bench/table container apparatus of the present invention, the apparatus being shown in a tabletop position.
Figure 2:
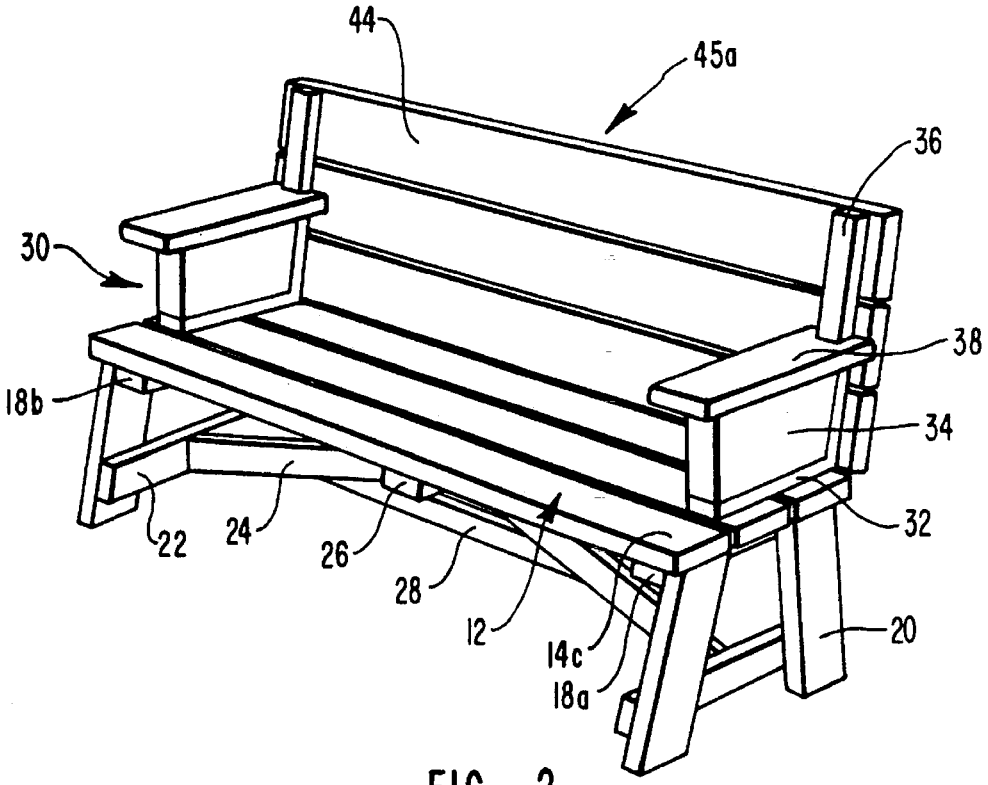
FIG. 2 is a perspective view illustrating one presently preferred embodiment of the convertible bench/table container apparatus of the present invention, the apparatus being shown in a bench formation.

FIGS. 1 and 2 illustrate one presently preferred embodiment of the convertible bench/table apparatus 10 as including a seat 12 comprising longitudinal seat boards 14*a*, 14*b*, 14*c* positioned over a support frame 16. The longitudinal seat boards 14*a*, 14*b*, 14*c* extend substantially horizontal above and across the support frame 16 and are fixed to seat supports 18*a*, 18 *b* at each end by multiple fasteners, such as screws (or bolts).

Beneath the seat supports 18*a*, 18*b* are positioned a plurality of seat support legs 20. The seat support legs 20 are composed of a sturdy wood with relative thickness and durability for reinforcing the seat 12 and weight applied thereon. The seat support legs 20 vertically engage the seat supports 18*a*, 18*b* at a slight inward angle from the base of each respective seat support leg 20. The height of the seat 12 is determinative from the vertical length and height of the seat support legs 20 when positioned thereunder and adjacent the support frame 16. The seat supports 18*a*, 18*b* are mounted and secured to the seat support legs 20 by multiple fasteners, such as screws (or bolts).

A cross-sectional support means 22 connects the two seat support legs 20 found on one side of the frame 16. The cross-sectional support means 22 horizontally engages the inner side of two seat support legs 20 at a position close to the base of each support leg. The cross-sectional support means 22 is rigidly attached to each support leg 20 by multiple fasteners, such as screws (or bolts).

Two seat cross-braces 24, preferably made of wood, extend from the cross-sectional support means 22 upwardly between approximately 30° and 35° to meet a midsection seat brace 26 positioned half-way between the seat supports 18*a*, 18*b*. A proximal end 23 of each seat cross-brace 24 is rigidly connected to the adjoining cross-sectional support means 22 by multiple fasteners, such as screws (or bolts), being passed through the seat cross-braces 24 and further introduced into the adjoining cross-sectional support means 22. A distal end 25 of each upward extending seat cross-brace 24 engages the underside and/or opposite side of the midsection seat brace 26. The association between the seat cross-braces 24 and the midsection seat brace 26 involves a means for rigidly attaching the seat cross-braces to the underside and/or the opposite side of the midsection seat brace. Fastened to the upper surface of the midsection seat brace 26 are the longitudinal seat boards 14*a*, 14*b*, 14*c* of the seat 12

A horizontal reinforcement slat 28 lies underneath and parallel to the seat 12 and is operably connected to the adjacent seat cross-braces 24. The opposing ends of the reinforcement slat 28 are respectively secured at a mid-point on the adjacent seat cross-brace 24 by passing fasteners, such as screws (or bolts), through the end of each horizontal reinforcement slat 28 and into the adjoining seat cross-brace 24. The horizontal reinforcement slat 28 provides overall structural integrity to the support frame 16 of the convertible bench/table container 10 and the seat 12, to counteract the depression of forces exercised thereupon.

Resting upon the support frame 16 in a second position as represented in FIG. 2 are preferably two armrest assemblies 30. In one presently preferred embodiment, each armrest assembly 30 is composed of a four piece assembly, comprising: (1) a base board 32; (2) a second member 34, rectangular in shape and comprising a majority of the body of the armrest assembly 30, where the height of the second member 34 directly relates to the height consistency of the tabletop 45*b* when the convertible bench/table container is in a first position as represented in FIG. 1; (3) a lateral extension 38 resting on top of the second member 34 and extending transversely a greater length than the base board 32 and the second member 34, and (4) a backboard member 36 that extends upwardly and is interposed along the backside of the horizontal base board 32, the second member 34 and the lateral extension 38 and is rigidly attached thereto by multiple fasteners, such as screws (or bolts). The combination of the base board 32, the second member 34, the backboard member 36, and the lateral extension 38 comprises the armrest assembly 30 and each member thereof is affixed to each other by fasteners, such as, for example, an epoxy adhesive, furniture glue, multiple screws (or bolts).

Attached to the backside of the backboard member 36 of the armrest assembly 30 are longitudinal boards 44. The longitudinal boards 44 are preferably mounted to the backboard member 36 by multiple fasteners, such as screws (or bolts), to form a backrest/tabletop 45. When the convertible bench/table 10 is in the second position as represented in FIG. 2, the backboard member 36 lies in a upright position providing a backrest 45*a* for the seat 12 and exposing a bench for sitting and relaxing, while the body of the armrest assembly 30 lies substantially horizontal. When the convertible bench/table 10 is in the first position as represented by FIG. 1, the backboard member 36 lies substantially horizontal exhibiting a tabletop 45*b* and providing a table for a picnic, while the body of the armrest assembly 30 rests on its side in an upright position.

Figure 4:
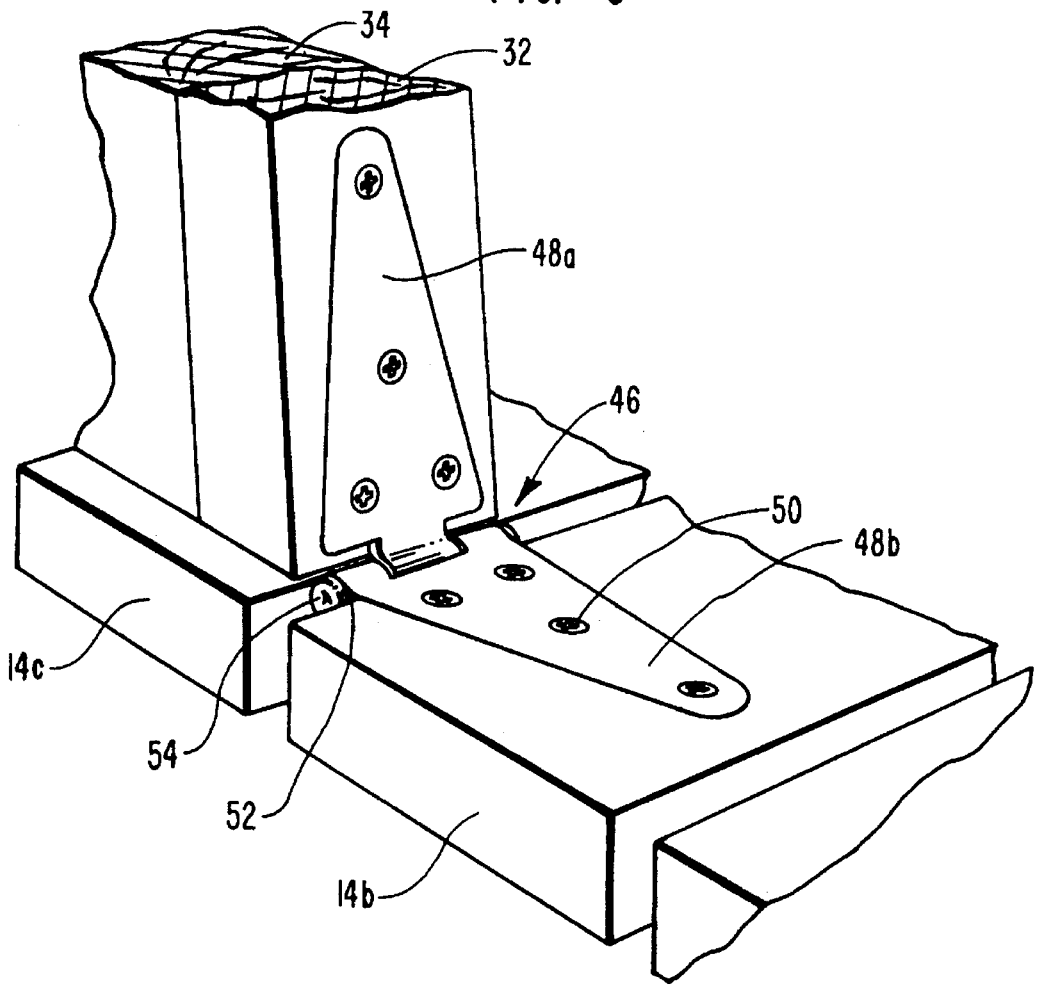
FIG. 4 is an enlarged perspective view taken along lines 4–4 of FIG. 3 showing the hinge mechanism of the armrest assembly which provides the pivotal motion in transforming the convertible bench/table container apparatus from the first position to the second position.

As represented by FIG. 4, affixed to the underside of the base board 32 of the armrest assembly 30 is a hinge bracket arm 48*a* that allows the armrest assembly to be pivoted from a horizontal position into a vertical position, where the backrest/tabletop 45 is transformed from a bench structure into a picnic table. The second arm 48*b* of the hinge bracket 46 is rigidly attached to the longitudinal seat board 14*b*. The intimacy of these connections is achieved by a means comprising a multiple of openings 50 formed in each hinge arm 48*a*, 48*b* of the hinge bracket 46 in which fasteners, such as screws (or bolts), can be introduced therethrough into the base board 32 with preferably a slight introduction into the body of the second member 34 of the armrest assembly 30.

The introduction of fasteners, such as screws (or bolts), through the openings 50 formed in the hinge arms 48*a*, 48*b* of the hinge bracket 46 and which are further fed into the body of the armrest assembly 30 and the longitudinal seat board 14*b*, conforms to a stable fastening where a pivotal means can be established therefrom. Located medially between the two bracket arms 48*a*, 48*b* of the hinge bracket 46, is an aperture 52 whereby a suitable hinge pin 54 can be inserted to accommodate the pivotal motion of the convertible bench/table 10 from the first position as represented in FIG. 1, to the second position as represented in FIG. 2, or vice versa. The aperture 52, encasing the hinge pin 54, is positioned substantially between the hinge bracket arms 48*a*, 48*b* in such a manner that when the backrest/tabletop 45 is pivoted around the medial axis of the hinge bracket 46, the backrest 45*a* becomes a suitable tabletop 45*b* which is structurally supported by the armrest assembly 30.

The base board 32 and the second member 34 of the armrest assembly 30 facilitate a surface abutment against the seat 12 by acting as a first structural stop 40 when the convertible bench/table container 10 is in a tabletop 45*b* formation as depicted in FIG. 1. The first structural stop 40 provides structural integrity to the tabletop 45*b* and those forces applied thereupon.

The lateral extension 38 of the armrest assembly 30 provides a surface abutment against the longitudinal seat board 14*c* equalizing a second structural stop 42 for support of the tabletop 45*b* when the convertible bench/table 10 is in the first position as represented in FIG. 1. The portion of the lateral extension 38 of the armrest assembly 30 that extends beyond the second member 34 of the armrest assembly 30 becomes substantially vertically displaced when the convertible bench/table container 10 is pivoted at the hinge bracket 46. Upon the substantial vertical displacement of the backrest/tabletop 45, the lateral extension 38 of the armrest assembly 30 abuts the forward seat support leg 20, as well as the front side of the longitudinal seat board 14*c*, thereby exerting a functional restriction on any further forward pivoting movement on the part of the backrest/tabletop 45, thus conforming to a second structural support stop 42.

When the presently preferred embodiment of the present invention is in the second position as shown in FIG. 2, the convertible bench/table container 10 conforms to a suitable bench with a seat 12, backrest 45*a* and at least one armrest assembly 30 which provides means for additional comfort to those persons relaxing thereupon.

Figure 5:
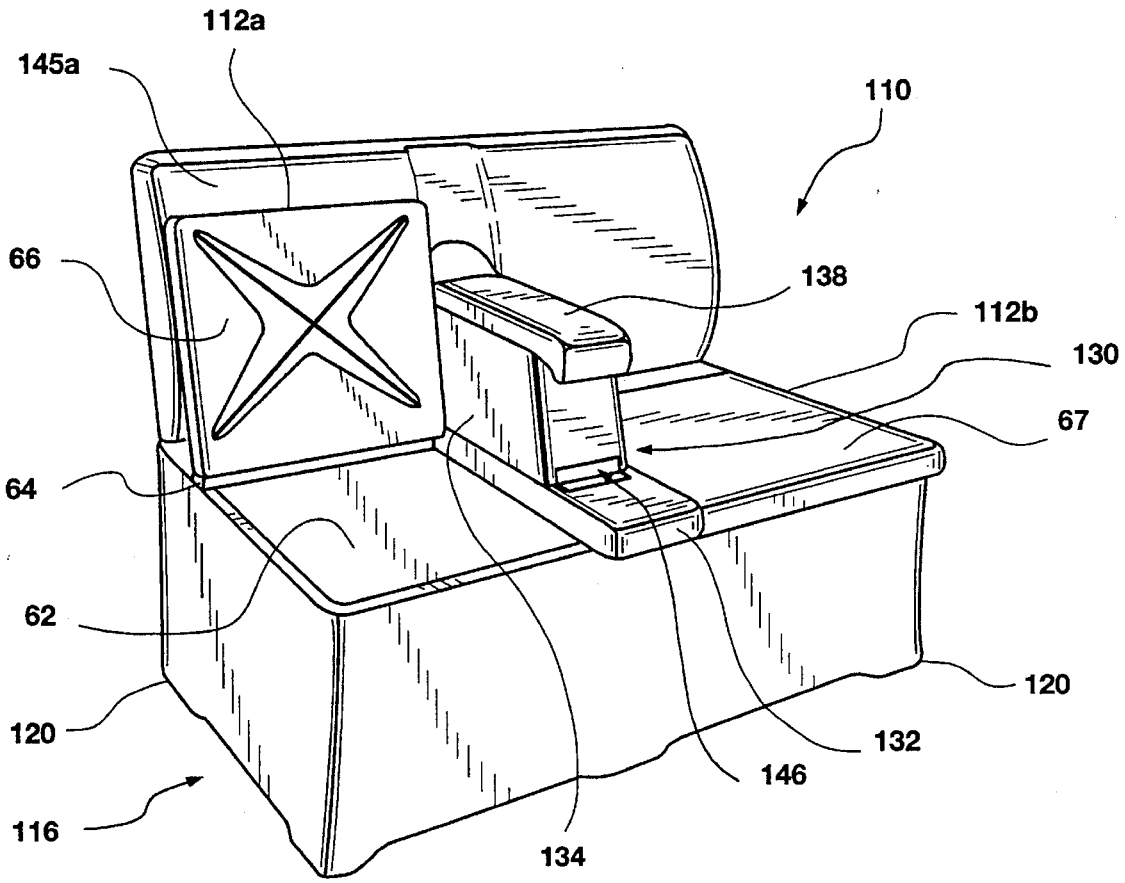
FIG. 5 is a perspective view illustrating a first alternate preferred embodiment of the convertible bench/table apparatus of the present invention, the apparatus being shown in a bench formation comprising a support frame having an internal chamber disposed therein.
Figure 6:
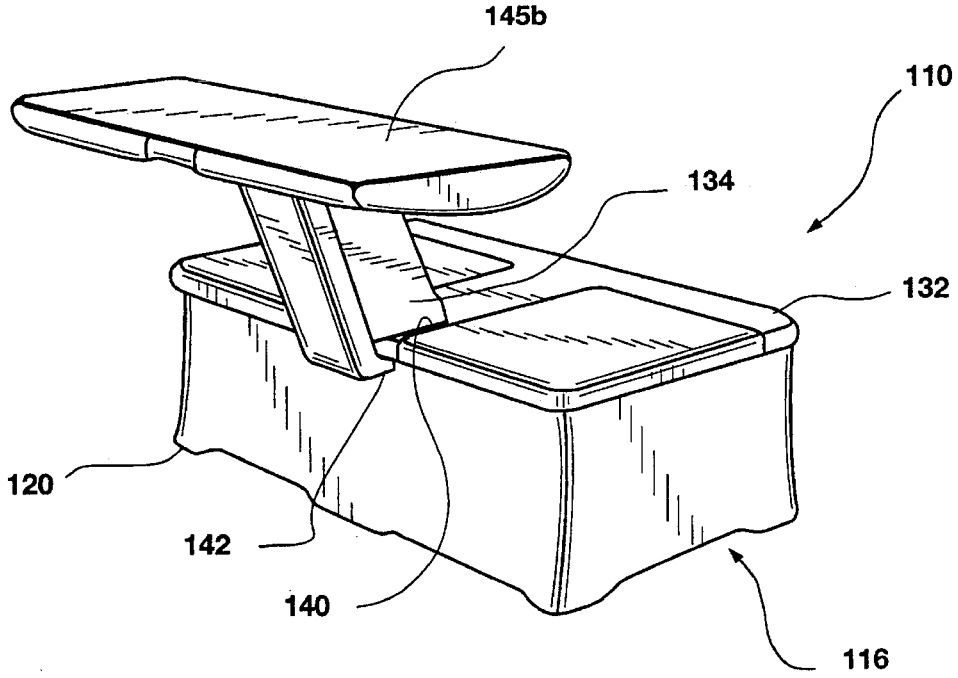
FIG. 6 is a perspective view illustrating a first alternate preferred embodiment of the convertible bench/table apparatus of the present invention, the apparatus being shown in a tabletop position.

FIGS. 5 and 6 illustrate an alternative preferred embodiment of the convertible bench/table apparatus 110 as comprising a support container assembly 116 having an internal storage chamber 62 disposed therein. The convertible bench/table container apparatus 110 of the present invention is preferably formed of a sufficiently sturdy, composite material having significant rigidity and endurance for the purposes of the present invention. Consistent therewith, the convertible bench/table container 110 of the present invention may be formed of a wide variety of other suitable materials, such as, for example, wood, metal, ceramic, fiberglass, graphite, any of numerous organic, synthetic or processed materials that are mostly thermoplastic or thermosetting polymers of high molecular weight and that can be molded, case, extruded, drawn or laminated into objects, or any other suitable composite or polymeric materials.

In current design, the support container assembly 116 is formed having multiple support legs 120. Support legs 120 provide means for elevating the support container assembly 116 from the surface of the floor or ground in order to protect the bottom of the support container assembly 116 from dirt, water, debris or other damaging substances.

Figure 7:
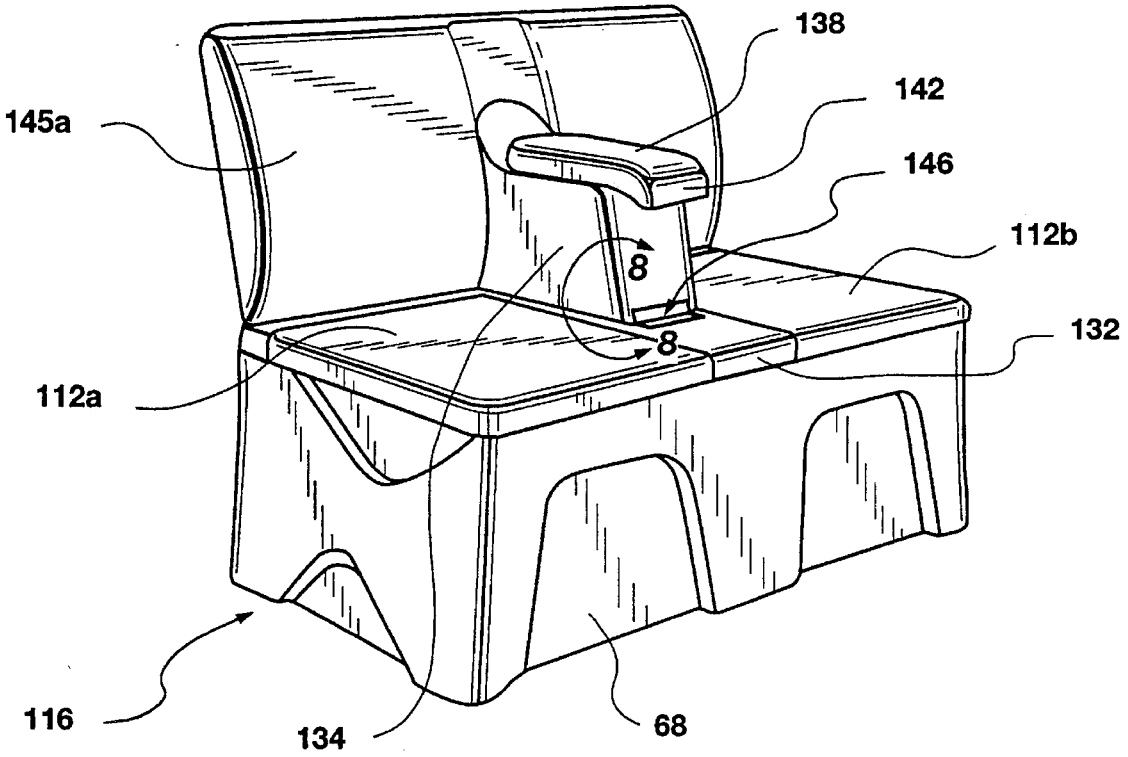
FIG. 7 is a perspective view illustrating a second alternate preferred embodiment of the convertible bench/table apparatus of the present invention, the apparatus being shown in a bench formation comprising a support frame having an internal chamber disposed therein and multiple recessed areas providing structural support to the frame.

As depicted in FIG. 7, a second alternative preferred embodiment of the support container assembly 116 of the convertible bench/table apparatus 110 is formed having multiple recessed areas 68 disposed on the exterior surface of the body of the support container assembly 116 whereby providing additional structural integrity and reinforcement to the support container assembly 116 thus aiding in counteracting the depression forces exercised thereon.

Referring back to FIG. 5, the support container assembly 116 is formed having a base board member 132 and one or more openable seat members 112*a*, 112*b*. The base board member 132 is securely attached to an upper portion of the support container assembly 116. Preferably, the base board member 132 is formed having a substantially T-shaped configuration which is preferably disposed over the upper portion of the support container assembly 116 by means of fasteners, such as, for example, adhesives, screws, bolts, rivets, etc.

Similarly, the external edges of the seat members 112*a*, 112*b* are operably disposed over a raised rim section of the upper surface portion of the support container assembly 116 and hingeably connected on opposite sides of the base board member 132. Alternatively, the seat members 112*a*, 112*b* can be removably disposed over the raised rim section of the upper surface portion of the support container assembly 116 without any hingeable connection. Preferably, the exterior surface 67 of seat members 112*a*, 112*b* comprises a substantially flat, smooth surface, which, as used herein, means that the surface is substantially free from roughness and projections. Further, the surface of seat members 112*a*, 12*b* may be formed having a concave or contoured shape for comfort. Accordingly, those skilled in the art will readily recognize other possible shapes or configurations which are consistent with the spirit and scope of the present invention.

When the hingeable seat members 112*a*, 112*b* are in a closed position, the external edges of the interior surface 66 of the seat members 112*a*, 112*b* are disposed in alignment with the raised rim of the upper portion of the support container assembly 116 whereby providing structural support to the seat members 112*a*, 112*b*. In addition, since depression forces are directly applied against the seat members 112*a*, 112*b*, an internal reinforcing structure may also be formed on the interior surface 66 of the seat members 112*a*, 112*b* to provide additional structural integrity, as shown in FIG. 5.

In current design, the seat members 112*a*, 112*b* are hingeably attached at one end to the base board member 132 Preferably, the seat members 112*a*, 112*b* are connected to the base board member 132 by an elongated hinge-like structure 64 disposed between the contacting edges of the base board member 132 and the seat members 112*a*, 112*b*.

The elongated hinge-like structure 64 connecting the seat members 112*a*, 112*b* to the base board member 132 is preferably formed of a substantially flexible material such as, for example, an organic, synthetic or processed thermoplastic or thermosetting polymer of high molecular weight which can be molded, cast, extruded, drawn or laminated onto objects, and which is sufficiently sturdy and capable of withstanding shock without permanent deformation. It will be readily appreciated, however, that the hinge-like structure 64 can, of course, be formed of a wide variety of suitable materials which are consistent with the spirit and scope of the present invention.

Alternatively, situated at any preferred location, one or more hinge-like structures 64 or conventional hinge brackets may be connected between the contacting edges of the base board member 132 and the seat members 112*a*, 112*b* to provide means for pivoting the seat members 112*a*, 112*b* from an open position to a closed position, or vice versa, over the support container assembly 116. Moreover, a lid support connection preferably secured within the internal storage chamber 62 of the support container assembly 116 at a first end and operably engaging the interior surface 66 of the seat members 112*a*, 112*b* at a second end could be provided to maintain the seat members 112*a*, 112*b* in an open position for ready access into internal storage chamber 62.

As noted above, the seat members 112*a*, 112*b* operate as means for facilitating access to the internal storage chamber 62 formed within the support container assembly 116. In particular, the internal chamber 62 can be used to provide storage means for children's toys, blankets, clothing, as an ice chest, etc. Alternatively, the internal storage chamber 62 can be partitioned into one or more separate storage chambers.

Resting on the base board member 132 in a second position is an armrest assembly 130. In one presently preferred alternate embodiment of the present invention, the armrest assembly 130 comprises a second member 134 and a lateral extension 138 attached thereto and extending transversely a length greater than the length of the second member 132. In design, the second member 134 is substantially rectangular in shape and comprises a majority of the body of the armrest assembly 130. Similarly, the height of the second member 134 directly relates to the height consistency of the tabletop (or desktop) 145*b* when the convertible bench/table container apparatus 110 is in a first position, as represented in FIGS. 5 and 7. Moreover, the second member 134 is formed having an angle of disposition at between approximately 25° and 35°. In this regard, the angular disposition of the second member 134 in respect to the base board member 132 provides a substantial relationship to the distance of the tabletop (or desktop) 145*b* from the edge of the support container assembly 116, as illustrated in FIG. 6.

Attached to the backside of the second member 134 of the armrest assembly 130 is a backrest 145*a* secured by means of fasteners such as, for example, screws, bolts, rivets, an adhesive, etc. Preferably, the configuration of the backrest 145*a* is ergonomically designed to provide a suitable structure for comfort and durability. When the convertible bench/table container 110 is in the second position as represented by FIGS. 5 and 7, the armrest assembly 130 lies substantially horizontal providing a backrest 145*a* for the seat members 112*a*, 112*b* and exposing a bench for sitting and relaxing. When the convertible bench/table container 110 is in the first position as represented by FIG. 6, the body of the armrest assembly 133 jests on its side in an upright position thereby exhibiting a tabletop (or desktop) 145*b*.

Figure 8:
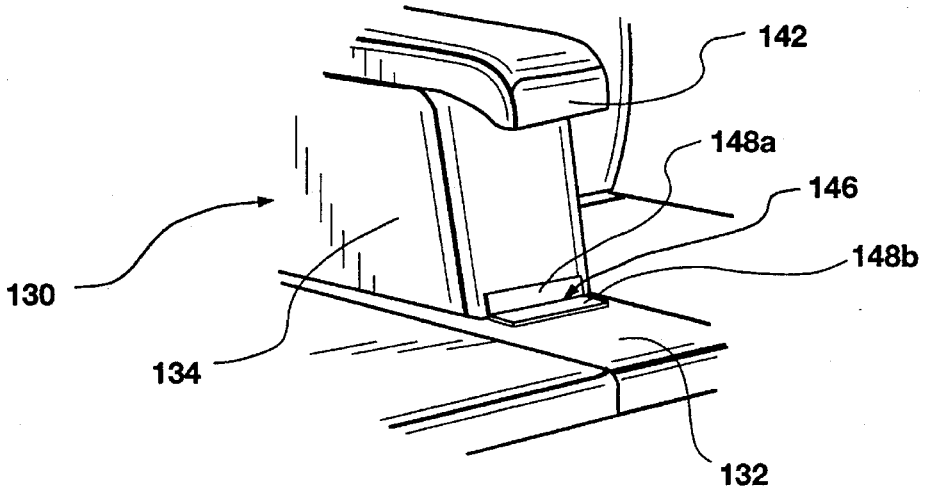
FIG. 8 is an enlarged perspective view taken along lines 8—8 of FIG. 7 showing the hinge mechanism of the armrest assembly which provides the pivotal motion in transforming the convertible bench/table container apparatus from a first position to a second position.

As represented by FIG.8, the second member 134 of the armrest assembly 130 is preferably attached to the base board member 132 by means of an elongated hinge-like structure 146 disposed between the facing of the second member 134 and the upper surface of the base board member 132. The elongated hinge-like structure 146 integrally connecting the second member 134 of the armrest assembly 130 to the base board member 132 is preferably formed of a substantially flexible material such as, for example, an organic, synthetic or processed thermoplastic or thermosetting polymer of high molecular weight which can be molded, cast, extruded, drawn or laminated onto objects, and which is sufficiently sturdy and capable of withstanding shock without permanent deformation. It will be readily appreciated, however, that the hinge-like structure 146 can, of course, be formed of a wide variety of suitable materials which are consistent with the spirit and scope of the present invention.

In current design, the hinge-like structure 146 provides means for allowing the armrest assembly 130 to be pivoted from a horizontal position into a vertical position, where the backrest/tabletop 145 is transformed from a bench into a picnic table or desktop. Alternatively, situated at any preferred location, one or more hinge-like structures 146 or one or more conventional hinge brackets may be connected between the second member 134 and the base board member 132 to provide alternative means for pivoting the backrest/tabletop 145 from the first position to the second position, or vice versa.

Similarly, the elongated L-shaped hinge bracket 146 having a first hinge bracket arm 148*a* attached to the front surface of the second member 134 and a second hinge bracket arm 148*b* attached to the base member 132 can be used to facilitate the pivotal connection therebetween, as shown in FIG. 8. Alternatively, the second hinge bracket arm 148*b* may be situated underneath the second member 134 to hid the second bracket arm 148*b* from view. Moreover, the hinge bracket arm 148*a* may be situated underneath the second member 134. To compensate for the thickness offset of the hinge bracket 146, a recessed area may be formed on the second member 134 and/or within the base member 132, as needed.

Referring back to FIG. 6, the second member 134 of the armrest assembly 130 facilitates a surface abutment against the base board member 132 by acting as a first structural stop 140 when the convertible bench/table container 110 is in a tabletop (or desktop) 145*b* formation. The first structural stop 140 provides structural integrity to the tabletop (or desktop) 145*b* and those forces applied thereupon.

Similarly, the lateral extension 138 of the armrest assembly 130 provides a surface abutment against the support container assembly 116 facilitating a second structural stop 142 for supporting the tabletop (or desktop) 145*b*. The portion of the lateral extension 138 of the armrest assembly 130 that extends beyond the body of the second member 134 becomes substantially vertically displaced when the convertible bench/table container 110 is pivoted at the hinge bracket 146.

Upon the substantial vertical displacement of the backrest/tabletop 145, the lateral extension 138 abuts the front side of the support container assembly 116, thereby exerting a functional restriction on any further forward pivoting movement on the part of the backrest/tabletop 145, thus conforming to a second structural support stop 142.

In current design, the preferred and alternate embodiment of the convertible bench/table apparatus are preferably constructed of 100% natural redwood, however, other suitable materials may be used in the construction of the convertible bench/table or bench/table container, such as other types of woods or wood products, any of numerous organic, synthetic or processed materials that are mostly thermoplastic or thermosetting polymers of high molecular weight and that can be molded, cast, extruded, drawn or laminated, fiberglass composite materials, metals, or any other suitable material sufficient to accommodate the novel functional and structural elements and features of the present invention.

Overall, the structure and design of the convertible bench/tables of the present invention are aesthetically pleasing to the eye and furnish a pleasant seating and/or dining experience for those persons leisurely relaxing in the yard, on the porch, or near the pool. Moreover, the presently preferred embodiments of the convertible bench/table apparatus can also be used indoors for sitting, dining, or as a workstation when converted into the tabletop (or desktop) formation.

In use, for example, if a family wants to eat out on the lawn, near the pool, or at a nearby campground, the convertible bench/table container apparatus can be conveniently placed into the back of a truck for easy transportation to the campground, or quickly and easily converted into a suitable picnic table where it sits. Consistent therewith, one or more handle members can be securely attached to the body of support container assembly for easing the manipulation of the convertible bench/table container apparatus. By lifting and pivoting the backrest and armrest assembly on its side, accomplished by the hinge means and structural stops, the backrest can be transformed into a tabletop (or desktop) providing a surface area for a family picnic or for accommodating other activities.

Figure 3:
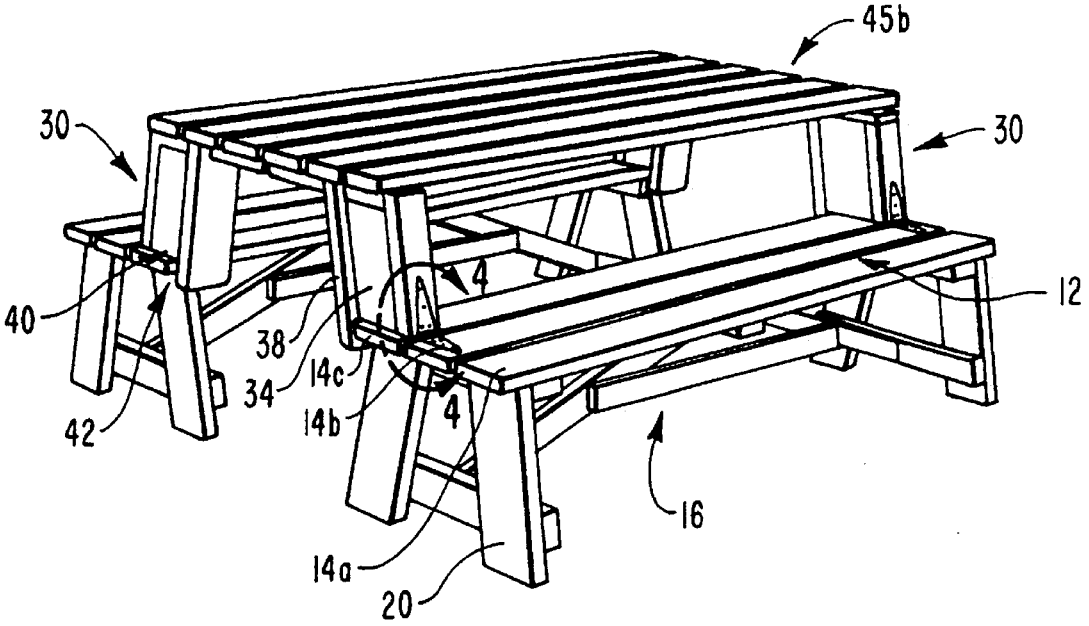
FIG. 3 is a perspective view of a convertible bench/table container apparatus in accordance with the present invention being aligned with an opposing convertible bench/table container apparatus to provide a larger tabletop surface, analogous to a conventional picnic table.

If a larger tabletop is required to feed family and friends, a pair of convertible bench/tables of the present invention can be transformed into their tabletop formations and placed on opposite sides, thus aligning the two tabletops together to form a larger tabletop with sturdy seats on the opposite sides thereof, as represented in FIG. 3.

From the above discussion, it will be appreciated that the present invention provides a new and improved functional and structural design for convertible bench/table structures. The invention provides an aesthetically pleasing piece of recreational furniture which can be made from natural redwood construction and finished with an outdoor ultraviolet weather resistant stain to preserve the wood's natural beauty, or the present invention can be made from a composite material for its lightweight, strength and durability. Additionally, the present invention has a reduced number of mechanical working parts, as compared to prior art devices, thereby effecting a decrease in the overall manufacturing and production costs.

The apparatus of the present invention is easy to assemble, and provides a simple, easy means for converting a bench structure into a picnic table (or desktop) formation. In addition, the present invention provides an alternative preferred embodiment of the convertible bench/table apparatus comprising a support container assembly having an internal storage chamber disposed therein for storing children's toys, blankets, clothing, for use as an ice chest, etc. Consistent therewith, both the preferred and alternate embodiments of the present invention provide both convenience and usage indoors and outdoors. Thus, during the inventors' experimentation, the present invention has been shown to have significant and effective advancements both functionally and structurally over known prior art devices.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A convertible bench/table container apparatus, comprising:

at least one seat member;

a means for supporting said seat member, said support means having an internal chamber disposed therein;

a backrest/tabletop member;

means for pivoting said backrest/tabletop member from a first position, exhibiting said seat member with an adjacent tabletop, into a second position, exhibiting said seat member with a backrest; and means for structurally supporting said backrest/tabletop member comprising at least one structural stop engaging said means for supporting said seat member, said structural stop providing means for sustaining said tabletop when the backrest/tabletop member is pivoted into said first position, and wherein said means for structurally supporting said backrest/tabletop member comprises a hingeable engagement with said means for supporting said seat member when said backrest/tabletop member pivoted into the second position.

2. A convertible bench/table container apparatus as defined in claim 1 wherein said seat member is openably attached to said means for supporting said seat member.

3. A convertible bench/table container apparatus as defined in claim 1 wherein said means for supporting said seat member comprises a support container assembly.

4. A convertible bench/table container apparatus as defined in claim 1 wherein said means for pivoting said backrest/tabletop member comprises a hinge structure.

5. A convertible bench/table container apparatus as defined in claim 4 wherein said hinge structure comprises at least two extending arms having a hingeable connection integrally formed therebetween.

6. A convertible bench/table container apparatus as defined in claim 5 wherein said extending arms are rigidly attached to said means for supporting said seat member and said means for structurally supporting said backrest/tabletop member.

7. A convertible bench/table container apparatus as defined in claim 1 wherein said means for structurally supporting said backrest/tabletop member comprises an armrest assembly.

8. A convertible bench/table container apparatus as defined in claim 7 wherein said armrest assembly comprises a sustaining member and an extension member operably attached to said sustaining member, wherein said extension member extends slightly beyond a first end of said sustaining member.

9. A convertible bench/table container apparatus as defined in claim 1 wherein said means for structurally supporting said backrest/tabletop member further comprises a second structural stop for supporting the backrest/tabletop member when pivoted into the first position, said second structural stop forming a surface abutment between said means for structurally supporting said backrest/tabletop member and said means for supporting said seat member.

10. A convertible bench/table container apparatus, comprising:

at least one seat member;

a means for supporting said seat member, said support means having an internal chamber disposed therein;

a backrest/tabletop member;

means for pivoting said backrest/tabletop member from a first position, exhibiting said seat member with an adjacent tabletop, into a second position, exhibiting said seat member with a backrest, wherein said means for pivoting the backrest/tabletop member from said first position to said second position, and vice versa, comprises a hinge member; and an armrest assembly structurally supporting the backrest/tabletop member, said armrest assembly comprising at least one structural stop engaging said means for supporting said seat member, said structural stop providing means for sustaining said tabletop when the backrest/tabletop is pivoted into said first position, and wherein said armrest assembly comprises a hingeable engagement with said means for supporting said seat member when said backrest/tabletop is pivoted into the second position.

11. A convertible bench/table container apparatus as defined in claim 10 wherein said seat member is openably attached to said means for supporting said seat member.

12. A convertible bench/table container apparatus as defined in claim 11 wherein said openable attachment comprises a hinge structure.

13. A convertible bench/table container apparatus as defined in claim 10 wherein said seat member is removably positioned over an upper section of said means for supporting said seat member.

14. A convertible bench/table container apparatus as defined in claim 10 wherein said means for supporting said seat member comprises a support container assembly.

15. A convertible bench/table container apparatus as defined in claim 14 wherein said support container assembly comprises a base board member rigidly attached to an upper portion of said support container assembly.

16. A convertible bench/table container apparatus as defined in claim 10 wherein said means for pivoting said backrest/tabletop member comprises a hinge structure.

17. A convertible bench/table container apparatus as defined in claim 16 wherein said hinge structure comprises at least two extending arms having a hingeable connection integrally formed therebetween.

18. A convertible bench/table container apparatus as defined in claim 17 wherein said extending arms are rigidly attached to said means for supporting said seat member and said armrest assembly.

19. A convertible bench/table container apparatus as defined in claim 10 wherein said armrest assembly comprises a sustaining member and an extension member being operably attached to said sustaining member, wherein said extension member extends slightly beyond a first end of said sustaining member.

20. A convertible bench/table container apparatus as defined in claim 10 wherein said armrest assembly further comprises a second structural stop for supporting the backrest/tabletop member when pivoted into the first position, said second structural stop forming a surface abutment between said armrest assembly and said means for supporting said seat member.

* * * * *